United States Patent [19]

Kappenhagen

[11] 4,357,995

[45] Nov. 9, 1982

[54] HYDRAULIC SYSTEM INCLUDING OIL REPLENISHMENT FOR MULTI-STAGE HYDRAULIC JACK

[75] Inventor: George A. Kappenhagen, Stroud Township, Monroe County, Pa.

[73] Assignee: Westinghouse Electric Corp., Pittsburgh, Pa.

[21] Appl. No.: 219,100

[22] Filed: Dec. 22, 1980

[51] Int. Cl.[3] ..... B66B 11/04

[52] U.S. Cl. ..... 187/17; 91/169; 60/405

[58] Field of Search ..... 187/17, 28; 60/405, 60/403, 428, 459; 91/168, 169, 390

[56] References Cited

U.S. PATENT DOCUMENTS

| | | | |
|---|---|---|---|
| 191,516 | 6/1877 | Comings | 91/169 |
| 3,882,678 | 5/1975 | Fassbender | 60/405 |
| 4,043,428 | 8/1977 | White et al. | 187/17 |
| 4,116,577 | 9/1978 | Lauck | 60/405 |
| 4,201,053 | 5/1980 | Atkey | 60/459 |

FOREIGN PATENT DOCUMENTS

| | | | |
|---|---|---|---|
| 877869 | 9/1961 | United Kingdom | 91/169 |

*Primary Examiner*—Joseph J. Rolla
*Assistant Examiner*—Kenneth Noland
*Attorney, Agent, or Firm*—D. R. Lackey

[57] ABSTRACT

A hydraulic system having a single acting, mult-stage, synchronous hydraulic jack having a trapped oil space which provides the required synchronism. The hydraulic system additionally includes a first external pump in fluid flow communication with an oil space disposed between the outer cylinder and an intermediate section, and a second external pump disposed in fluid flow communication with the trapped oil space between the intermediate section and an inner plunger section. Oil leakage from the trapped oil space is detected when the sections are retracted. The next time the sections are to be extended following such detection, both pumps are automatically started, with the second pump being deactivated when the trapped oil space has been replenished.

3 Claims, 7 Drawing Figures

HYDRAULIC SYSTEM INCLUDING OIL REPLENISHMENT FOR MULTI-STAGE HYDRAULIC JACK

BACKGROUND OF THE INVENTION

1. Field of the Invention

The invention relates in general to hydraulic systems which utilize multi-stage or telescopic jacks, and more specifically to such jacks having a cylinder, an intermediate section, and a plunger section, with the intermediate and plunger sections moving in synchronism.

2. Description of the Prior Art

Multi-stage or telescopic hydraulic jacks of the synchronized type are suitable for such hydraulic systems as hydraulic elevators. The work "synchronized" refers to the fact that the intermediate and plunger sections operate simultaneously with equal movement, as opposed to successively. To extend the jack, hydraulic oil is forced into a first chamber between the cylinder or outer section and an end of the intermediate section. The oil in a second chamber which surrounds an end of the plunger section is sealed, and is referred to as the "trapped oil space". When oil is forced into the first chamber under pressure, it causes the intermediate stage to extend. Since the oil in the trapped oil space cannot compress, the plunger stage must extend to maintain the volume of the trapped oil space constant. The jack components are dimensioned such that one inch movement of the intermediate stage causes one inch movement of the plunger stage.

First, second and third seals, through which one stage moves relative to another, define the trapped oil space. The first and second seals are disposed between the inside wall of the outer cylinder section and the outside wall of the intermediate section, and the third seal is disposed between the inside wall of the intermediate section and the outside wall of the plunger section. Since the stages slide through the seals, some oil necessarily must leak past the seals, and when the oil leakage from the trapped oil space is great enough, the intermediate and plunger sections get out of synchronism, i.e., they no longer move uniformly together at the lower end of the travel range, and the maximum extension of the plunger section is reduced. Thus, in an elevator system, for example, the elevator car may be unable to reach the uppermost floor of the associated building when the leakage reaches a predetermined volume.

Since it is not desirable to manually replenish the oil in the trapped oil space, either periodically or when needed, because of the cost as well as the out-of-service time, the prior art has proposed many different arrangements for automatically replenishing the oil in the trapped oil space. For example, an external reservoir in communication with the trapped oil space, with a check valve, has been proposed. However, this requires that the reservoir be periodically filled. The most common prior art arrangement is some form of internal valving between the first and second chambers. The valving may automatically operate to replenish the oil in the trapped oil space due to the reduced spacing between the inner end of the plunger section and the inner end of the intermediate section when oil is required, or, the need for oil may be detected externally by a switch which modifies the operation of the jack to cause it to fully retract and operate internal replenishment valving.

While these prior art arrangements operate satisfactorily, it would be desirable to provide a new and improved hydraulic system which (a) eliminates the need for external reservoirs, which require replenishment, (b) which does not require an "abnormal" operation of the jack, i.e., a modification of the normal operation of the jack, and (c) which eliminates internal valving, which is difficult and thus costly to repair and maintain.

SUMMARY OF THE INVENTION

Briefly, the present invention is a new and improved hydraulic system having a single acting multi-section, synchronized hydraulic jack. In addition to the external pump which pumps oil into a first chamber located between the outer cylinder section and the inner end of the intermediate section, a relatively small second external pump is provided which is in fluid flow communication with a second chamber which defines the trapped oil space. The need for replenishing the oil in the trapped oil space is externally monitored, and upon detection of such need, the second pump is activated until the oil leakage volume has been replaced, which will usually take only a few seconds. In a preferred embodiment of the invention, wherein the hydraulic system is associated with an elevator system, the replenishment is not made the instant the need is detected, but the very next time the elevator car is started upwardly from the lowest floor of the building. When the elevator car is to start a normal run from the lowest floor, the anti-creep circuits are deactivated and the main pump is started. According to the teachings of the present invention, the prior detection of a need for replenishing the oil in the trapped oil space results in simultaneously starting both the main pump and smaller second pump at the start of a run. The second pump quickly replenishes the oil in the trapped oil space and shuts off. Any upward car movement due to such replenishment is unnoticed, as the car is starting an upward run anyway. Since the monitoring and replenishing means are entirely external to the hydraulic jack, the components may be easily inspected during normal periodic maintenance. Any required repair and/or replacement of components will be immediately apparent and quickly and easily accomplished.

BRIEF DESCRIPTION OF THE DRAWING

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1A:
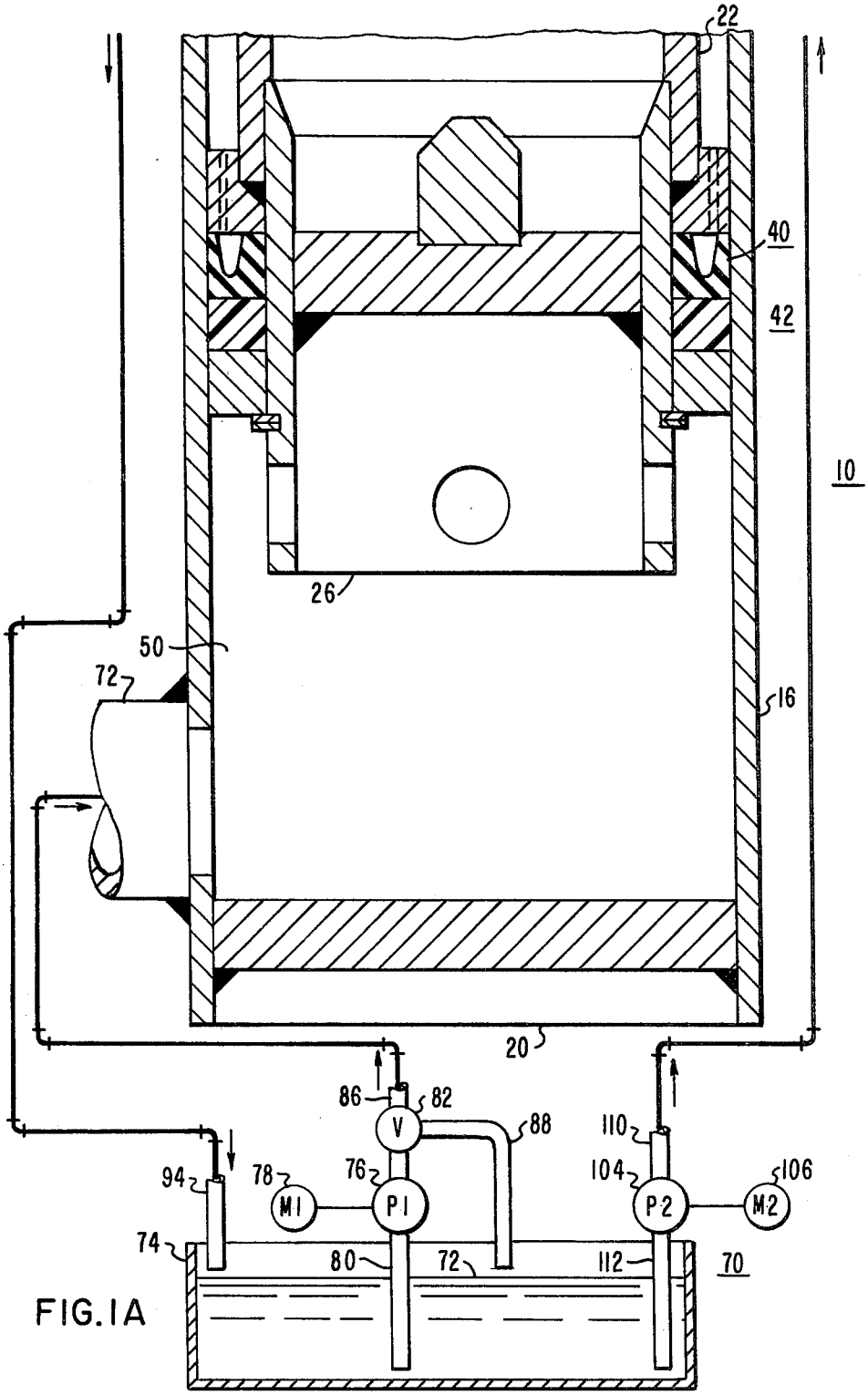
FIGS. 1A, 1B and 1C may be assembled to illustrate a hydraulic system constructed according to the teachings of the invention.
Figure 1B:
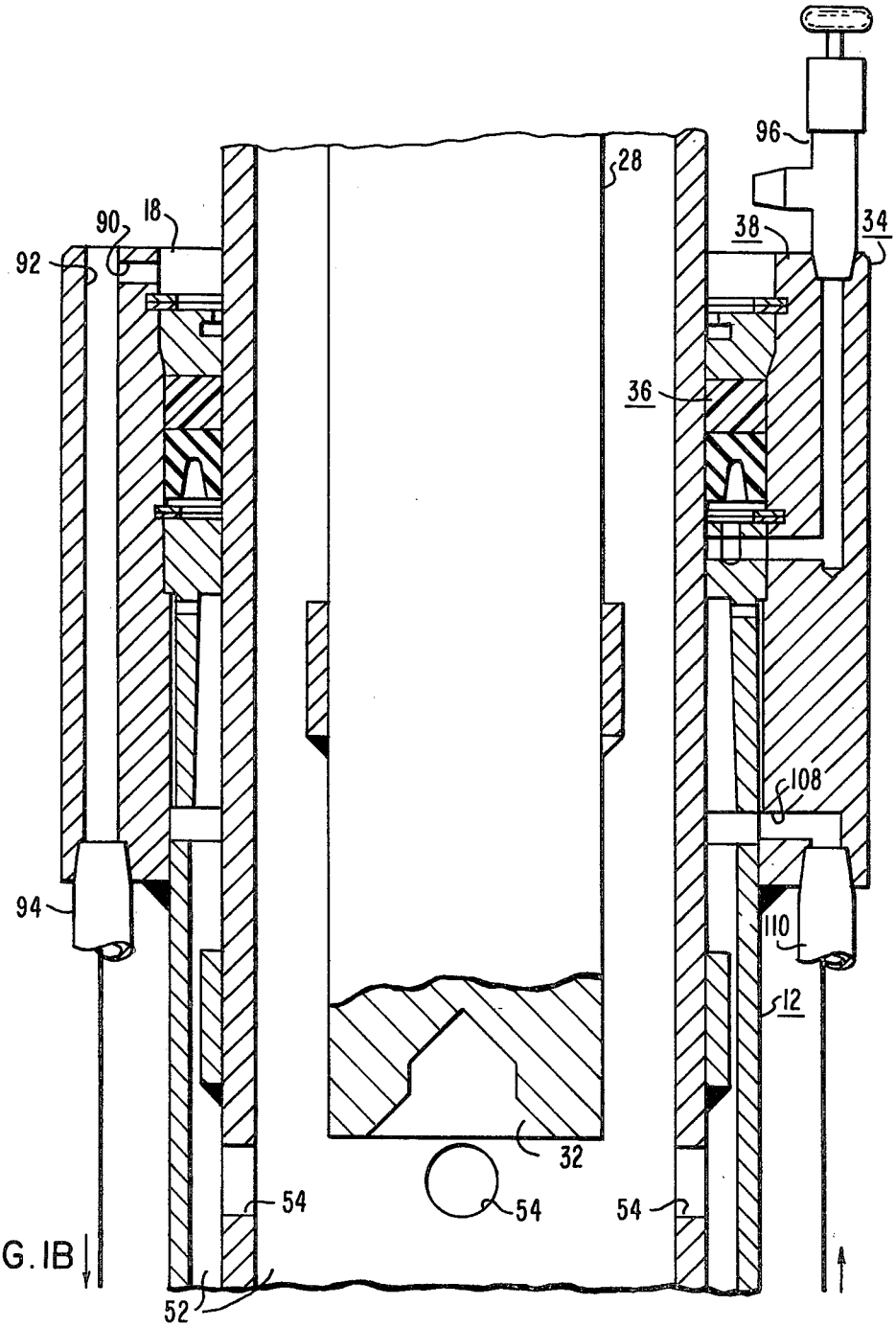
Figure 1C:
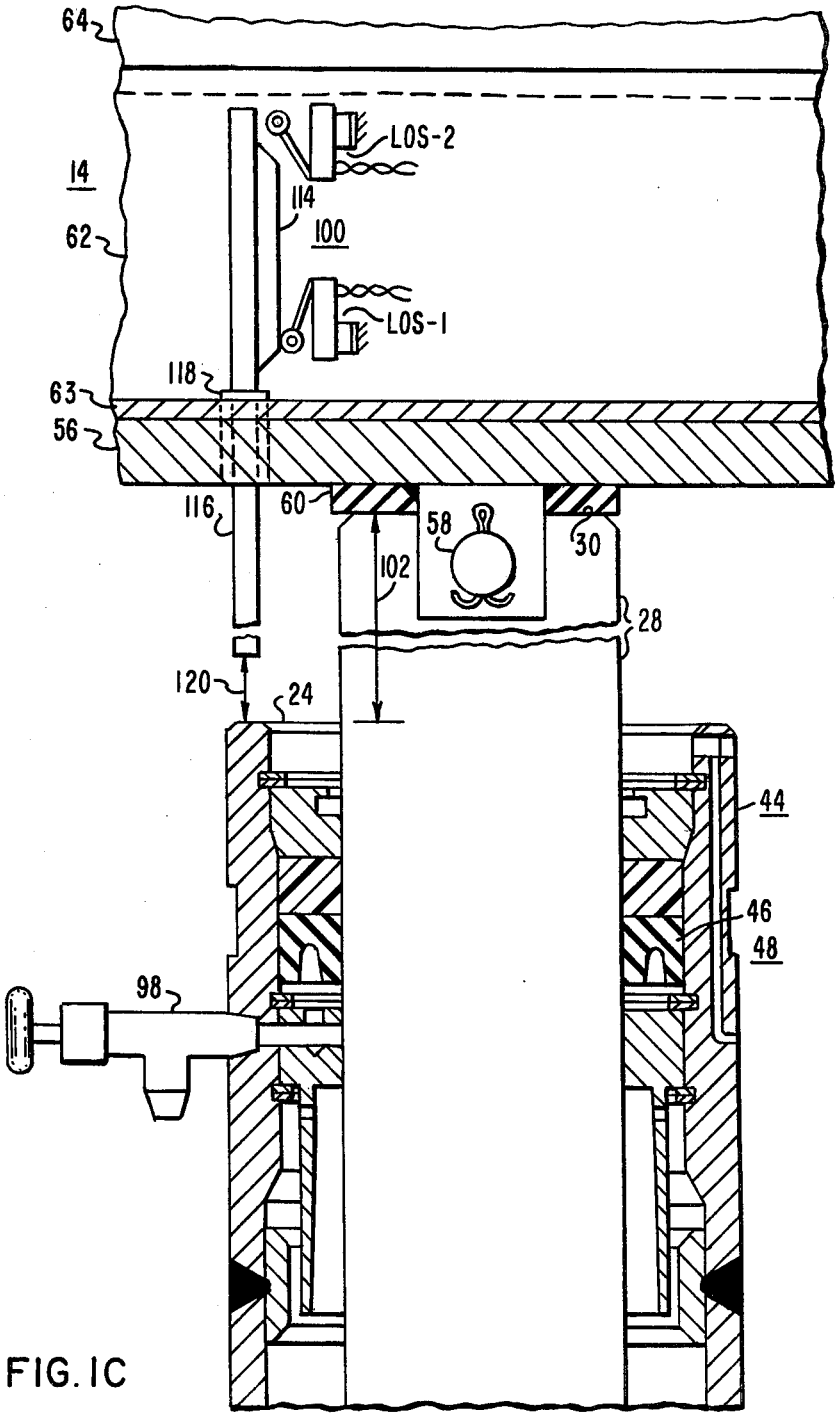

Referring now to the drawings, FIGS. 1A, 1B and 1C may be assembled to illustrate a hydraulic system 10 constructed according to the teachings of the invention. For purposes of example, hydraulic system 10 will be assumed to be a hydraulic elevator system, including a single acting, multi-section, synchronous jack 12, and an elevator car shown generally at 14. Jack 12 has an outer cylinder section 16 having first and second ends 18 and 20, respectively, an intermediate section 22 having first and second ends 24 and 26, respectively, and a plunger section 28 having first and second ends 30 and 32, respectively. The first ends of the cylinder and intermediate sections are open and their second ends are closed. The intermediate and plunger sections 22 and 28 are telescopically mounted, one within the other, and within the outer cylinder section 16, for end-wise extension towards their first ends, in response to fluid pressure exerted on the second ends 26 and 32 of the intermediate and plunger sections, respectively. The cylinder and intermediate sections are tubular in cross section having inner and outer surfaces, and the plunger section may be tubular, or, as illustrated, solid. A solid plunger reduces the overall diameter of the jack 12.

A first cylinder head 34 having a fluid seal and bearing combination 36 provides a first fluid seal 38, with the first fluid seal being disposed between the internal and external surfaces of the cylinder and intermediate sections 16 and 22. A fluid seal and bearing combination 40 provides a second fluid seal 42, with the second fluid seal also being disposed between the internal and external surfaces of the cylinder and intermediate sections 16 and 22.

A second cylinder head 44 having a fluid seal and bearing combination 46 provides a third fluid seal 48, with the third fluid seal 48 being disposed between the internal and external sufaces of the intermediate and plunger sections 22 and 28, respectively.

The second fluid seal 42 and the portion of cylinder section 16 located between fluid seal 42 and the second end 20 of cylinder section 16 define a first fluid chamber 50. The first fluid chamber 50 is in fluid pressure communication with the second end 26 of the intermediate section 22.

The first, second and third fluid seals 38, 42 and 48, respectively, define a second fluid chamber 52, also referred to as the trapped oil space 52. The second fluid chamber 52 includes a first portion, tubular in shape, located between the outer and inner surfaces of the intermediate and cylinder sections, the ends of which are sealed by the first and second fluid seals 38 and 42, respectively. The second fluid chamber 52 further includes a second portion within the intermediate section 22, between the third fluid seal 48 and the second end of the intermediate section 22. The first and second portions of the second fluid chamber 52 are in fluid flow communication with one another via a plurality of openings 54 disposed through the side wall of the intermediate section. The second fluid chamber 52 is in fluid pressure communication with the second end 32 of the plunger section 28.

A platen plate 56 is connected to the first end 30 of plunger section 28 via a connecting pin 58, with the end 30 of the plunger section 28 and the platen plate 56 being separated via a suitable resilient sound isolator pad 60. The elevator car 14 includes a bolster 62 bolted to the platen plate 56, and a platform assembly 64 fastened to bolster 62. Platform assembly 64 supports an elevator cab 56 shown in FIGS. 2A, 2B and 2C.

A hydraulic power supply 70 provides fluid power for operating jack 12, such as hydraulic oil 72 disposed in reservoir 74. A first hydraulic pump 76, driven by an electric motor 78, provides hydraulic oil 72 to the first fluid chamber 50 via an inlet pipe connection 78 secured to cylinder section 16. The inlet of pump 76 is in fluid flow communication with the hydraulic oil 72 via a pipe 80, and its outlet is connected to pipe connection 78 via a hydraulic elevator valve unit 82 and pipe sections 84 and 86. Valve 82 includes a pipe section 88 for returning hydraulic oil to reservoir 74. Valve 82 may be a conventional elevator valve, having electrically controlled up level, up stop, down level and down stop solenoids, as well as the conventional check and relief valves.

Hydraulic oil completely fills both the first and second fluid chambers 50 and 52, respectively. In a typical up cycle operation, motor 78 and the up level and up stop solenoids in valve 82 are energized to deliver hydraulic oil under pressure to jack 12 to provide maximum car speed in the up travel direction. As the elevator car 14 nears the target floor, i.e., the floor at which it is to stop, hatch switches sequentially deenergize the up level and up stop solenoids to stop the car at floor level. The pump motor is then deenergized shortly after the car stops at the floor. An anti-creep switch senses the position of the elevator car 14 adjacent to the floor at which it is stopped, to maintain the floor of the elevator car level with the floor of the building by re-energizing the pump and the up stop solenoid, as required.

Introducing hydraulic oil under pressure into the first fluid chamber applies pressure to the second end 26 of the intermediate section 22 and starts to move the intermediate section upwardly. The hydraulic oil in the trapped oil space 52 cannot compress but is pressurized when the intermediate section 22 starts to rise. The fluid pressure on end 32 of plunger 28 causes it to simultaneoulsy rise to maintain the same volume in the second fluid chamber 52, thus providing the synchronous action of jack 12. The various sections of jack 12 are dimensioned such that one inch rise of the intermediate section causes a one inch rise of the plunger section 28.

A down travel cycle returns hydraulic oil to reservoir 74, with both the down level and down stop solenoids in valve 82 being energized to provide maximum speed in the downward direction. Pump 76 is not actuated. Hatch switches sequentially deenergize the down level and down stop solenoids to stop elevator car 14 level with the desired target floor. As oil is returned from the first fluid chamber 50 to reservoir 74, the intermediate stage or section 22 travels downwardly and the plunger 28 moves synchronously with it to maintain the volume of oil in the trapped oil space 52 constant.

Since one section of the jack 14 slides relative to another through the fluid seals, some oil necessarily leaks past the fluid seals. Any oil which flows upwardly under pressure past the first fluid seal 38 is returned to reservoir 74 via openings 90 and 92 in cylinder head 34, and pipe 94. Oil forced upwardly past fluid seal 48, as well as oil which may be mixed with air when air bleed valves 96 and 98 are opened, is directed to the top of cylinder head 34 for return to reservoir 34.

A reduction in the volume of oil in the trapped oil space 52, however, will eventually reach the point where synchronism will be lost between the intermediate and plunger sections, and the maximum extension of plunger section 28 will be reduced. Thus, the elevator car 14 may be unable to reach the uppermost floor of the associated building. Thus, prior art hydraulic systems using telescopic jacks commonly utilize internal valves to replenish the oil in the second fluid chamber 52, with oil being directed from the first fluid chamber 50 into the trapped oil section 52.

The present invention not only eliminates internal valving, but it requires no abnormal operating procedures in order to replenish the oil in the trapped oil space. The oil in the trapped oil space 52 is monitored, and before it reaches a point where synchronism is lost, and before it reaches a point where the elevator car can no longer reach the uppermost floor, the lost oil is automatically replaced during a normal up cycle of the elevator car.

The monitoring of the oil in the trapped oil space 52 is conveniently accomplished via external electrical switches, and the replenishing of the oil is accomplished via external oil lines, thus making it easy to inspect and maintain the resynchronizing feature, unlike the prior art arrangements which utilize internal valving.

More specifically, oil monitoring means 100 is provided which monitors oil in the trapped oil space 52 by monitoring the dimension 102 between the first end 30 of the plunger section 28 and the first end 24 of the intermediate section 22 when the elevator car is located at the lowest floor of the building. When the trapped oil space 52 is filled with oil, and the elevator car is parked at the lowest floor, the intermediate and plunger sections will each have a like extension. As oil leaks from the trapped oil space 52 over a period of time, the extension of the plunger section 28 out of the intermediate section 22 will be gradually reduced. The elevator car 14 will stop correctly at floor level, and it will be maintained at floor level during this period, because the extension of the intermediate section 22 out of the cylinder section 16 will be automatically increased accordingly. Before dimension 102 is reduced to the point where the hydraulic system 10 malfunctions in some way, such as by the elevator car failing to reach the top floor of the building, monitoring means 100 provides a signal which initiates the replenishment of oil in the trapped oil space 52. This replenishment is accomplished via a second pump 104 driven by an electric motor 106. Cylinder head 34 is provided with an opening 108, one end of which is in communication with the trapped oil space 52, and the other end of which is in communication with an external pipe 110. External pipe or oil line 110 is connected to the outlet of pump 104, and the pump inlet is in communication with the hydraulic oil 72 in reservoir 74 via a pipe 112. The second pump 104 may be a small gear pump driven by a fractional HP motor, such as Webster Electric Company's HB series gear pump having a $\frac{1}{4}$ to $\frac{1}{2}$ HP drive motor. A pump having a 900–1,000 psi gage working pressure is suitable.

FIG. 1 illustrates an exemplary embodiment of the monitoring means which utilizes first and second electric switches LOS-1 and LOS-2, respectively, such as microswitches, and a cam 114 mounted on a vertically slidable operating rod 116. Two switches are utilized to insure that the second pump, once actuated, runs long enough to completely replenish the oil in the trapped oil space. However, a single switch with a suitable time delay may be used to accomplish the same result. For example, a single switch may pick up a relay having a time delay and drop out, with this relay actuating the second pump. The operating rod 116 may be slidably mounted for vertical movement through suitable aligned openings in the platen plate 56 and bolster 62, with a stop 118 being fixed to rod 116 to provide the desired clearance dimension 120 between the lower end of rod 16 and the first end 24 of the intermediate section 22. The bolster 62 has a substantially U-shaped cross sectional configuration, with the leg portions of the U-shaped configuration having sufficient height to provide space for accommodating the switches and cam. The lower end of rod 116 may be aligned with the top edge of cylinder head 44, for example. The weight of rod 116, stop 118 and cam 114 will normally keep stop 118 against the bottom or bight portion 63 of the bolster 62. In this normal position, the lower edge of cam 114 is disposed to contact the operating arm of switch LOS-1. In the exemplary embodiment, switch LOS-1 is normally closed, and cam 114 thus actuates it to its open position. Switch LOS-2 has its actuating arm spaced vertically above cam 114. Switch LOS-2 is normally open in this exemplary embodiment, with the actuation of its operating arm closing its contacts. Cam 114 is constructed such that switch LOS-2 will be "on the cam" even when the plungers have bottomed, such as might occur when the car is shut down for an extended period. Thus, the circuits will operate properly when the system is started in this condition.

Figure 2C:
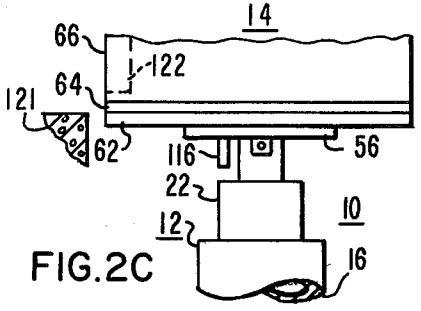
FIGS. 2A, 2B and 2C illustrate steps in the detection of the need for additional oil in the trapped oil space, and the replenishment thereof at the start of a normal up cycle of a hydraulic elevator.
Figure 2B:
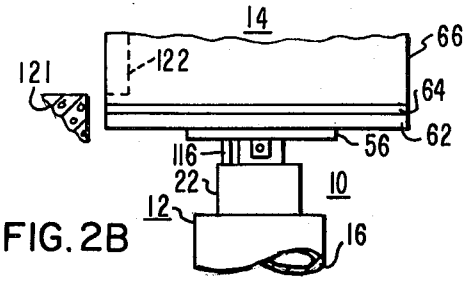
Figure 2A:
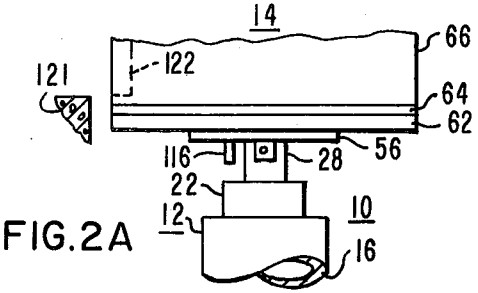

FIGS. 2A, 2B and 2C illustrate the operation of monitoring means 100 and the oil replenishment function, with FIG. 2A illustrating the elevator car 14 parked at the lowest floor or landing 121, with its floor, indicated by the bottom of elevator 122, being aligned with floor 121 of the building. In FIG. 2A, the volume of oil in the trapped oil space is normal and the bottom end of rod 116 is vertically spaced above the first end of the intermediate section 22. As oil leaks from the trapped oil space 52 over a period of time, dimension 120 between the bottom of rod 116 and the first end 24 of the intermediate section is reduced until rod 116 contacts end 24 of the intermediate section and lifts cam 114 vertically upward. Switch LOS-1 is almost immediately actuated back to its normally closed position to prepare the resynchronizing circuits, as will be hereinafter explained, but switch LOS-2 is not actuated until cam 114 is lifted a predetermined dimension, in order to provide hysteresis which causes the second pump 104 to run for a sufficient length of time, once actuated, in order to insure replenishment of the trapped oil space.

In a preferred embodiment of the invention, the second pump 104 is only started when the first pump 76 is started, at the start of a normal up cycle from the lowest floor 121. At the start of an up run, the anti-creep circuits which keep the elevator car level with the building floor between runs, are no longer effective, and thus any upward movement of the car due to replenishment of the oil in the trapped oil space, as indicated in FIG. 2C, will be unnoticed by passengers in the car. The pumps are not started until the car door 122 is completely closed, and the elevator car is starting an up travel cycle, so the initial upward movement, which may be due to the second pump, will be smoothly continued by the first pump, even when the starting motor for the first pump is started with a wye-delta starter.

Figure 3:
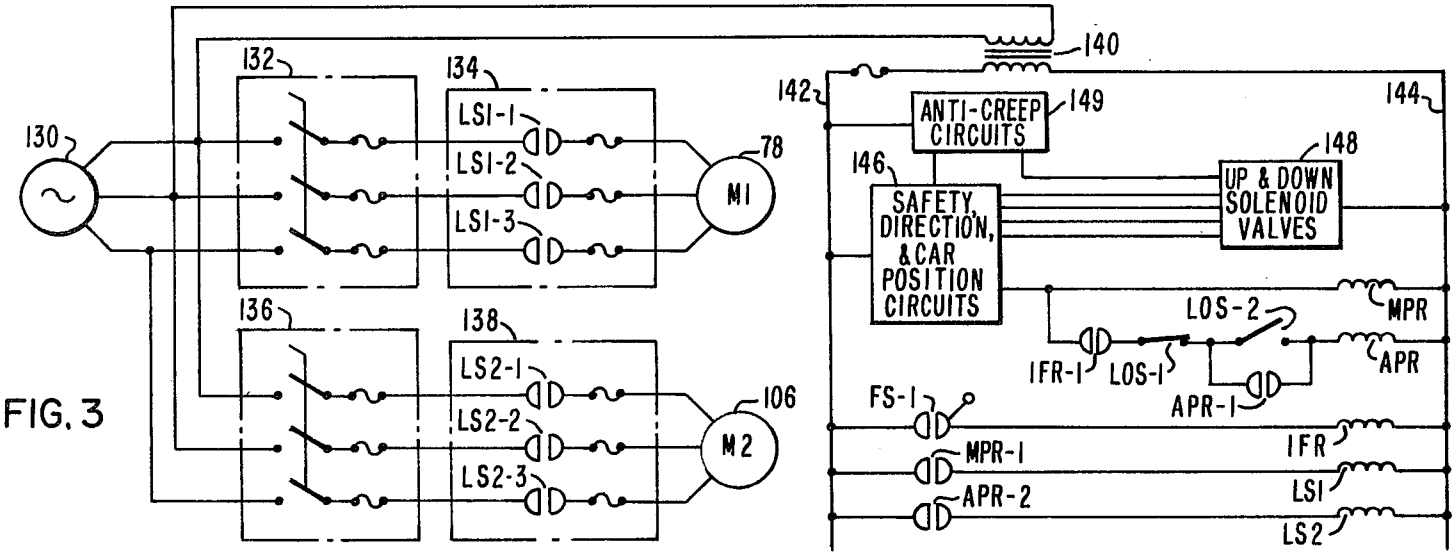
FIG. 3 is a schematic diagram of an elevator system constructed according to an embodiment of the invention.

FIG. 3 is a schematic diagram illustrating an implementation of the preferred embodiment of the invention wherein oil replenishment is accomplished when needed, at the start of a normal up travel cycle of the elevator car 14 from the lowest floor 121. Pump motor 78 is connected to a three-phase source 130 of alternating electrical potential via a circuit breaker 132 and a line starter 134. Pump motor 136, which may be a three-phase motor, as illustrated, or single-phase, as desired, is connected to source 130 via a circuit breaker 136 and a line starter 138. A suitable control voltage may be obtained from source 130 via a control transformer 140, providing an AC control voltage between conductors 142 and 144, as illustrated, or, the output of transformer 140 may be rectified to provide a unidirectional control voltage, as required.

The normal safety circuits, direction circuits, and car position circuits, are shown generally at 146, and the up and down solenoids for operating the various sections of valve 82 shown in FIG. 1A are shown generally at 148. The anti-creep circuits for maintaining the elevator car level with the floor between runs, is shown generally at 149. Circuits 146 and solenoids 148 are serially connected between conductors 142 and 144. A pump relay for pump 76 has its coil MPR connected between conductors 142 and 144 via the circuits 146. The line starter 134 for pump motor 178 has its operating coil LS1 connected between conductors 142 and 144 via a normally open contact MPR-1 of pump relay MPR. Thus, when the car and hatch doors, and other safety contacts are all closed, and the elevator car is set to make a run in the up direction, the up level and up stop solenoids shown generally at 148 are energized, as is the coil MPR which in turn closes its contact MPR-1 to energize coil LS1 of line starter 134, to start motor 78 and pump 76.

According to the teachings of the invention, a pump relay APR for the second pump 104 is provided which is connected from the safety circuits 146 to conductor 144 via a normally open contact 1FR-1, and switches LOS-1 and LOS-2. Pump relay APR has a normally open contact APR-1 connected across switch LOS-2, and a normally open contact APR-2 connected to energize the operating coil LS2 of line starter 138 when it closes. Contact 1FR-1 is a contact of a main or lowest floor relay 1FR which is connected between conductors 142 and 144 via a floor switch FS-1 which is closed only when the elevator car 14 is located at the lowest floor.

In the operation of the circuits shown in FIG. 3, it will be assumed that the elevator car 14 is stopped at the lowest floor and that monitoring means 100 has detected a low oil condition. Switch LOS-1, which has been held open, is now unactuated and thus closed, and switch LOS-2 is now actuated to its closed position. The first floor switch FS-1 is closed, and the first floor relay 1FR is energized which results in its contact 1FR-1 being closed. Thus, when the safety and direction circuits 146 all close at the start of an up run, the pump relays MPR and APR are both simultaneously energized, closing contacts MPR-1 and APR-2, respectively, to energize coils LS1 and LS2 of line starters 134 and 138, respectively. Thus, both pumps 76 and 104 start simultaneously at the beginning of an up run from the first floor. While the trapped oil space is being replenished, which only takes one or two seconds, the plunger section 28 will start to rise and cam 114 will drop away from the actuating arm of switch LOS-2 and allow switch LOS-2 to open. However, relay APR remains energized via its now closed contact APR-1. Relay APR remains energized until cam 114 reaches its normal position, indicating complete replenishment of the oil in the second fluid chamber 52, at which time cam 114 actuates switch LOS-1 to open its contact which drops relay APR and which in turn drops line starter coil LS2 of line starter 138. The up level and up stop solenoids are then energized to cause the oil from pump 76 to flow into the hydraulic jack, instead of bypassing back to the tank.

While replenishing the oil by starting both pumps 76 and 104 simultaneously at the start of a normal up cycle of an elevator car from the first floor is the preferred embodiment, since it involves the same functions now used by a normal hydraulic elevator, i.e., the second pump is only started when the first pump is started, at the start of a normal run in the up direction, sequencing of the pumps in any suitable manner is within the scope of the broad invention wherein the trapped oil space is automatically replenished without resorting to internal valving or special supply reservoirs, which substantially increase maintenance cost.

In summary, the present inventon automatically compensates for oil loss in the trapped oil space, regardless of the leakage path, i.e. through seals, air bleed valves, or even through the small external replenishment pump 104. No internal valving is required, and no unusual operating procedures are required. Replenishment automatically occurs, when needed, at the start of a normal up cycle from the lowest floor.

While the invention has been described relative to a jack having a single trapped oil space, it applies to jacks having additional stages and thus more than one trapped oil space. The system described would simply be repeated for each additional trapped oil space.

I claim as my invention:

1. A hydraulic system, comprising:

a single acting, multi-stage, synchronous hydraulic jack, said hydraulic jack including an outer cylinder section having first and second ends, an inner plunger section having first and second ends, an intermediate section having first and second ends disposed between said outer cylinder section and said inner plunger section, with said inner and intermediate sections being telescopically mounted, one within the other, and within said outer cylinder section, for endwise extension toward their first ends in response to fluid pressure, first and second fluid seals disposed between the interior and exterior surfaces of the intermediate and outer sections, respectively, and a third fluid seal disposed between the interior and exterior surfaces of the intermediate and inner sections, respectively, said first, second and third fluid seals defining a first fluid chamber disposed in fluid pressure communication with the second end of said intermediate section, and a second fluid chamber disposed in fluid pressure communication with said inner plunger section, hydraulic fluid in said first and second fluid chambers, monitoring means providing a predetermined signal when the hydraulic fluid in said second fluid chamber has been reduced by a predetermined amount, first fluid supply means including a first pump and a reservoir of hydraulic fluid disposed external to said jack for introducing hydraulic fluid into said first fluid chamber when endwise extension of said intermediate and inner plunger sections is desired, second fluid supply means including a second pump disposed external to said jack, said second pump introducing hydraulic fluid from said reservoir into said second fluid chamber in response to said monitoring means providing its predetermined signal, and control means for simultaneously activating both the first and second pumps when the hydraulic jack is to be extended and the monitoring means has provided the predetermined signal.

2. A hydraulic system, comprising:

a single acting, multi-stage, synchronous hydraulic jack, said hydraulic jack including an outer cylinder section having first and second ends, an inner plunger section having first and second ends, an intermediate section having first and second ends disposed between said outer cylinder section and said inner plunger section, with said inner and intermediate sections being telescopically mounted, one within the other, and within said outer cylinder section, for endwise extension toward their first ends in response to fluid pressure, first and second fluid seals disposed between the interior and exterior surfaces of the intermediate and outer sections, respectively, and a third fluid seal disposed between the interior and exterior surfaces of the intermediate and inner sections, respectively, said first, second and third fluid seals defining a first fluid chamber disposed in fluid pressure communication with the second end of said intermediate section, and a second fluid chamber disposed in fluid pressure communication with said inner plunger section, hydraulic fluid in said first and second fluid chambers, monitoring means providing a predetermined signal when the hydraulic fluid in said second fluid chamber has been reduced by a predetermined amount, first fluid supply means including a first pump and a reservoir of hydraulic fluid disposed external to said jack for introducing hydraulic fluid into said first fluid chamber when endwise extension of said intermediate and inner plunger sections is desired, second fluid supply means including a second pump disposed external to said jack, said second pump introducing hydraulic fluid from said reservoir into said second fluid chamber in response to said monitoring means providing its predetermined signal, an elevator car operably connected to the inner plunger section and mounted for movement in a vertical path which includes a lowest normal stop level, and control means simultaneously activating both pumps when the elevator car is at the lowest normal stop level, the monitoring means has provided the predetermined signal, and the elevator car is starting a normal run in the up direction from said lowest normal stop level.

3. A hydraulic system, comprising:

a single acting, multi-stage, synchronous hydraulic jack, said hydraulic jack including an outer cylinder section having first and second ends, an inner plunger section having first and second ends, an intermediate section having first and second ends disposed between said outer cylinder section and said inner plunger section, with said inner and intermediate sections being telescopically mounted, one within the other, and within said outer cylinder section, for endwise extension toward their first ends in response to fluid pressure, first and second fluid seals disposed between the interior and exterior surfaces of the intermediate and outer sections, respectively, and a third fluid seal disposed between the interior and exterior surfaces of the intermediate and inner sections, respectively, said first, second and third fluid seals defining a first fluid chamber disposed in fluid pressure communication with the second end of said intermediate section, and a second fluid chamber disposed in fluid pressure communication with said inner plunger section, hydraulic fluid in said first and second fluid chambers, monitoring means providing a predetermined signal when the hydraulic fluid in said second fluid chamber has been reduced by a predetermined amount, said monitoring means monitoring the dimension between the first ends of the intermediate and plunger sections when the hydraulic jack has retracted such that the first end of the plunger section is at a predetermined location, said monitoring means including first and second spaced switches and a cam member which is operated in response to the distance between the first ends of the intermediate and plunger sections, with the first switch being actuated when the second fluid chamber is properly filled with hydraulic fluid, and the second switch being actuated when the hydraulic fluid in the second fluid chamber has been reduced by a predetermined amount, first fluid supply means including a first pump and a reservoir of hydraulic fluid disposed external to said jack for introducing hydraulic fluid into said first fluid chamber when endwise extension of said intermediate and inner plunger sections is desired, and second fluid supply means including a second pump disposed external to said jack, said second pump introducing hydraulic fluid from said reservoir into said second fluid chamber in response to said monitoring means prviding its predetermined signal.

* * * * *